United States Patent [19]

Johnson et al.

[11] Patent Number: 4,457,121

[45] Date of Patent: Jul. 3, 1984

[54] CONTINUOUS MOTION BOTTLE PACKER

[75] Inventors: Lloyd D. Johnson, Portland; John L. Raudat, North Madison, both of Conn.

[73] Assignee: Standard-Knapp, Inc., Portland, Conn.

[21] Appl. No.: 425,104

[22] Filed: Sep. 27, 1982

[51] Int. Cl.[3] ..... B65B 35/46; B65B 35/54; B65B 57/14

[52] U.S. Cl. ..... 53/56; 53/247; 53/248

[58] Field of Search ..... 53/247, 248, 543, 249, 53/539, 55, 56, 57, 58, 507, 508

[56] References Cited

U.S. PATENT DOCUMENTS

| | | | |
|---|---|---|---|
| 2,819,576 | 1/1958 | Hendricks et al. | 53/248 X |
| 2,890,553 | 6/1959 | Day et al. | 53/247 X |
| 2,921,425 | 1/1960 | Seval | 53/247 |
| 3,353,331 | 11/1967 | Rowekamp | 53/249 X |
| 3,481,108 | 12/1969 | Englander et al. | 53/248 X |
| 3,561,189 | 2/1971 | Raudat | 53/543 X |
| 3,589,094 | 6/1971 | Pearson | 53/247 X |
| 3,672,117 | 6/1972 | Shuttleworth et al. | 53/247 X |
| 3,673,756 | 7/1972 | Prete et al. | 53/247 X |
| 3,744,213 | 7/1973 | Pearson | 53/247 X |
| 3,832,826 | 9/1974 | Ullman | 53/247 X |
| 4,078,361 | 3/1978 | Hartness et al. | 53/539 |
| 4,191,003 | 3/1980 | Talarico | 53/247 |

*Primary Examiner*—Horace M. Culver
*Attorney, Agent, or Firm*—McCormick, Paulding & Huber

[57] ABSTRACT

A plurality of grids are mounted individually on spokes of a wheel so that each grid moves through an article infeed station where groups of articles are fed into the grids without interrupting their forward speed. The orbit of the grids is such that each grid also moves through a discharge station where the article groups are dropped into packing cases again without interrupting the motion of the articles in the direction of a packing case conveyor.

26 Claims, 20 Drawing Figures

CONTINUOUS MOTION BOTTLE PACKER

This invention relates generally to packers of the type which drop groups of articles such as bottles into upwardly open packing cases, and deals more particularly with a packer having several grid structures for handling groups of articles to be so packed. The grids are provided in a structure which moves each grid in turn through an infeed station where the groups of articles are fed into the grid without interrupting their forward speed, and wherein each grid is in turn moved through a discharge station were each group of articles is dropped into a packing case, again without interrupting the motion of the articles or the packing case.

The chief aim of the present invention is to provide for continuous motion of the article groups to be packed, and to thereby avoid the speed limitations inherent with present day drop packers generally.

BACKGROUND OF THE INVENTION

Prior art drop packers of the type wherein the flow of articles must be interrupted so that the packer can drop the contents of a grid structure downwardly into an upwardly open packing case are shown in prior art U.S. Pat. No. 3,353,331 issued to Rowekamp in 1967, and U.S. Pat. No. 3,561,189 issued to Raudat in 1971.

The prior art also shows the general concept of handling articles in groups so that they are picked up at one point in the orbit of a carrier and subsequently moved to a discharge station which is associated with a packing case. The following patents are cited as being relevant to this general packaging approach. Sevel U.S. Pat. No. 2,921,425, Pearson U.S. Pat. No. 3,589,094, Pearson U.S. Pat. No. 3,744,213, and Ullman U.S. Pat. No. 3,832,826. These patents suggest that the articles to be picked up at an infeed station must be gripped somehow in order to be moved around a portion of the orbit path for the pickup mechanism so as to be suitably controlled for deposit in a packing case fed tangentially to the orbit path.

In the present invention the articles at the infeed station are continuously moving and unique grid structures are provided which move through the infeed station at a horizontal component of speed matched to that of the infeed speed for the articles themselves with the result that the articles are picked up without necessity for any gripping action. The grid structures are so designed that the articles can be subsequently drop packed into a packing case, again without interruption of the motion of either the grid structure or the packing case to be loaded.

SUMMARY OF THE INVENTION

In its presently preferred form the continuous motion bottle packer includes article conveyor means for advancing the bottles continuously in side-by-side columns along a first horizontal path. These articles are arranged in end-to-end relationship between lane dividers, and in predetermined groups corresponding to the capacity of the cases to be packed. A conventional divider may be utilized to split the articles into the desired number of lanes. A grouper is provided at a slightly slower speed than underlying article lane conveyors in order to allow predetermined numbers of articles to advance in orderly groups toward an infeed station. Indexing means is preferrably provided at the downstream ends of the lane conveyors so as to assure that the article groups move in timed relationship into the orbiting grid structures which carry the groups of articles to a discharge station where they are deposited into upwardly open packing cases, all without interruption of the speed of movement of both the articles and the packing cases.

The infeed station at the downstream end of the lane conveyors includes fixed cantilever mounted fingers for slidably receiving the columns or lanes of articles, and these fingers are spaced laterally to define horizontally extending openings therebetween. The grid structures are designed to pass upwardly through these finger openings as a result of the unique construction of each grid. Each grid consists of longitudinally extending support rails which carry corner posts defining pockets for the individual articles. Front and rear cross members of each grid structure are provided for supporting the ends of the rails, and the corner posts have upper portions which fit between adjacent articles in the advancing article group as each grid moves upwardly through the infeed station.

The grid structures move in a circular orbit oriented in vertical plane and it is a feature of the present invention that the instanteous tangential direction of movement for the grid structures entering the infeed station forms an angle with the horizontal path of the articles themselves arriving at the infeed station in the range between 45 and 30 degrees. Furthermore, the horizontal component of velocity for the grid structures at this point is maintained at substantially the same horizontal speed as that of the articles under the control of article group indexing means associated with the conveyor means.

Thus, the articles move at substantially constant controlled speed into the infeed station and the grid structures themselves are rotated at a constant angular speed. Each grid structure includes pivoted vanes for engaging the underside of the articles at the infeed station and these vanes receive each article in the group so as to carry the articles away from the infeed station without interrupting their forward motion. A smooth transition for the motion of the articles is achieved from a straight line to a circular orbit in order to carry them to a discharge station.

The discharge station is defined at the low point of the orbit and it is a further feature of the present invention that the case conveyor for moving cases through the discharge station is driven at a speed which varies cyclically to correspond to the horizontal component of motion for the grid structure moving through the discharge station in this circular orbit. At the low point, or slightly ahead of the low point in the oribit, the pivoted vanes supporting the articles are retracted beneath the support rails in the grid structure and the articles are allowed to free fall into the upwardly open packing case moving immediately below the grid structure itself. A funnel structure is provided in the grid structure for guiding the articles into the packing case or into individual pockets defined in the packing case, and to also decelerate the articles as they are dropped, again without interrupting the motion for the articles as they drop into the continuously moving packing case.

DETAILED DESCRIPTION

Figure 1:
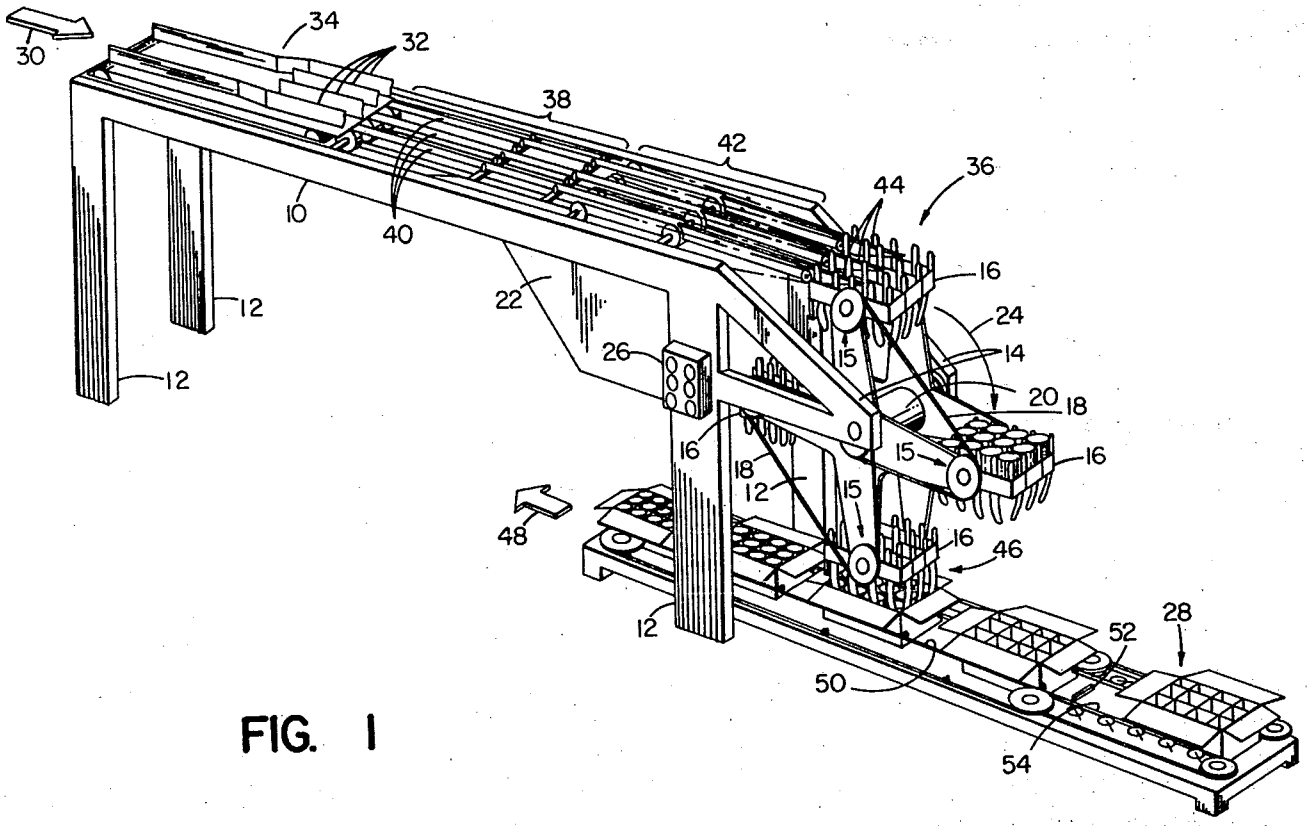
FIG. 1 is a perspective view of a continuous motion bottle packer constructed in accordance with the present invention.

Turning now to the drawings in greater detail, and referring particularly to FIG. 1, a continuous motion packer is there illustrated in schematic fashion with portions broken away to better illustrate the various elements which comprise the apparatus of the present invention. A fixed framework 10 is supported on vertical posts 12, 12 and two of these posts include a cantilever structure 14, 14 for rotatably supporting a plurality of grid structures 16, 16 so that these grid structures move in a circular orbit at a constant angular velocity and with support hubs 15 for each of these grid structures interconnected by chains or belts 18, 18 which serve to maintain each individual grid structure 16 in a horizontal relationship as it moves around the orbit in a generally vertical plane on the axis defined by the main hub 17. Housing 22 contains drive means for continuously rotating the grid structures 16, 16 in the direction of the arrow 24 and a control panel 26 is provided for this grid drive means and other suitable drive means associated with the various conveyor elements in the elevated framework 10, and for driving the case conveyor means indicated generally at 28.

The main hub 17 is driven by the grid drive means at a speed which can be varied to increase or decrease the number of cases being packed per unit time, but this hub 17 is otherwise driven at a constant angular speed through a one way overload clutching mechanism (not shown) to provide for stopping the orbital motion of the grids in the spider shaped grid support frame or wheel F in the event of jamming or other inadvertent interruption of grid movement. Each of the grids is supported on hubs 15, 15. At least one hub includes a spring loaded pin and detent assembly such that the relative rotation between the spider wheel and the grid structure (provided for by the chains 18, 18) can be interrupted in the event of a jam or other inadvertent event effecting a particular grid.

Figure 16:
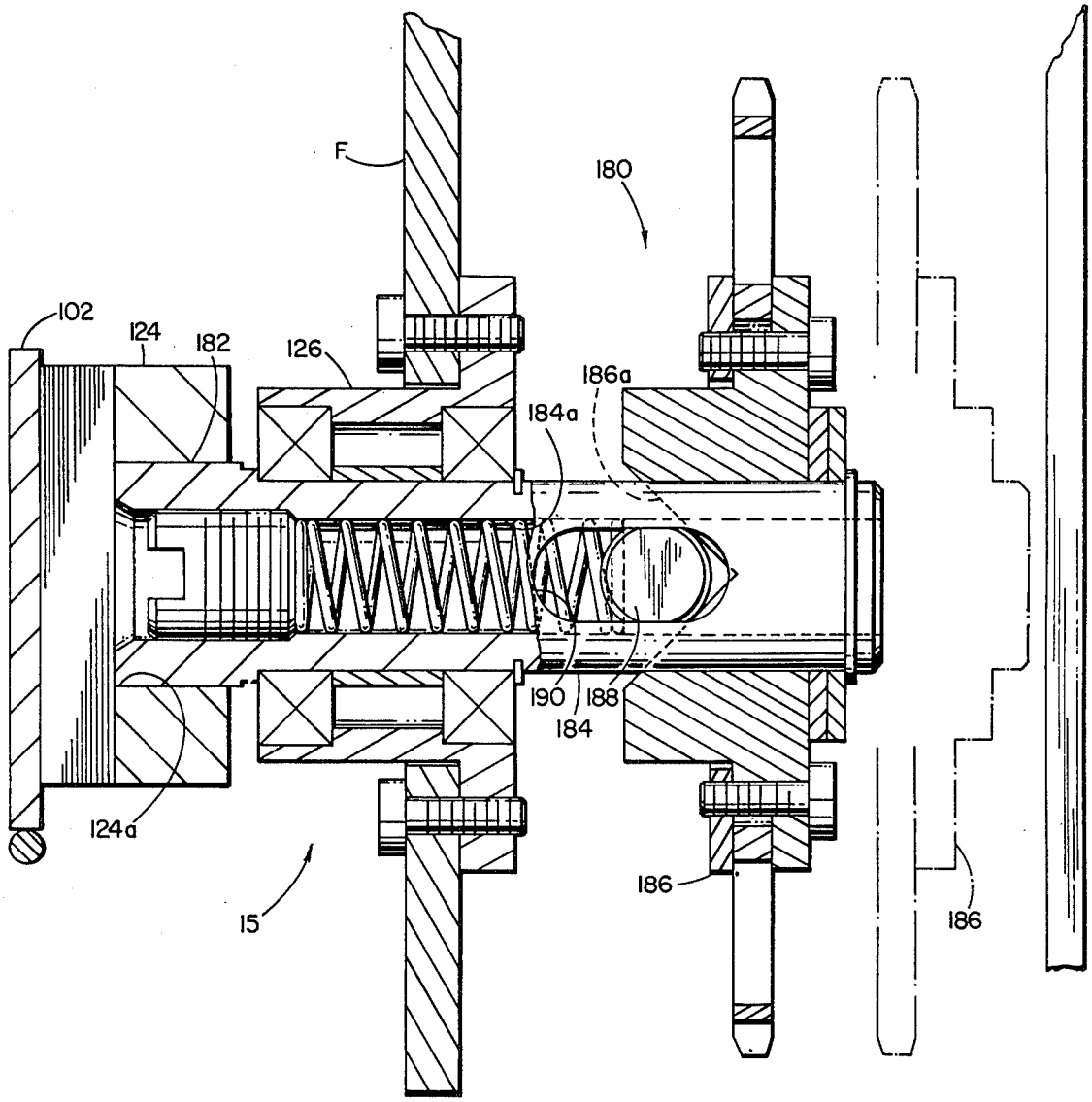
FIG. 16 is a sectional view through one of the grid support hubs in FIG. 12 and shows the drive sprocket in two positions, the phantom line position illustating a disengaged condition.

FIG. 16 illustrates in section a presently preferred construction for one such hub 15 and the associated pin and detent assembly 180.

The grid 16 is mounted to the block 124, as indicated previously that is by attachment by block 124 to the grid rail 102 in FIG. 16. As shown in FIG. 16 block 124 has a square cavity 124*a* for receiving the square head portion 182 of stub shaft 184. The shaft 184 has a central bore 184*a* and is journaled in bearing 126. A sprocket 186 is rotatably received on the shaft 184 but normally drives this shaft (to keep the grid horizontal) through a V-shaped detent 186*a* in the sprocket hub and a pin 188 in a slot 190 of the shaft 184. This pin is spring biased toward the position shown for it, but relative axial movement between this pin 188 and V-shaped detent 186*a* (as suggested by the phantom line position for sprocket 186) will allow the grid to depart from the horizontal orientation shown in FIG. 1.

Articles such as glass bottles are continuously fed in the direction of arrow 30 in FIG. 1 between lane dividers 32, 32 and these articles may be nested as initially fed into the upstream end of the elevated structure 10, but will be divided, by suitable divider means 25, into orderly columns so as to pass downstream in the direction of the arrow 30 between the lane dividers 32, 32 and toward and infeed station indicated generally at 36 in FIG. 1. Prior to arrival at the infeed station 36 the articles will be grouped into slugs or charges of articles corresponding to the size of the cases to be filled as for example four articles per column and three side-by-side lanes in the version illustrated in FIG. 1. The means for so grouping the articles is indicated generally at 38 in FIG. 1.

Individual lane conveyors 40, 40 are also operated from the drive means in housing 22 so as to move or urge the articles continuously in the downstream direction and it is a feature of the present invention that the grouper 38 comprises pins provided on a slightly slower speed chain conveyor system such that the line pressure of the on coming articles can be interrupted by the grouper such that the indexing means 42 can take over between the grouper 38 and the infeed station 36 and feed these groups of articles in orderly fashion to the infeed station 36 where they are phyiscally lifted from projecting fingers 44, 44 to be moved in the orbit described above from the infeed station 36 to a discharged station 46 associated with the case conveyor.

Cases on the case conveyor move in the direction of the arrow 48 along a horizontal path opposite in direction and spaced below that for the articles on the article conveyor means and these cases are moved in a controlled condition through the discharge station 46 by a case conveyor 50 which consists in side belts with case pushers carried thereby to move each case in a carefully controlled condition and that a speed which is matched to the horizontal component of velocity of the grid structure 16 moving through the discharge station 46. Thus, conveyor 50 operates at a variable speed under the control of a sinusoidally varying conveyor drive in timed relationship with the indexing article conveyor portion 42 and the rotational speed of the grid structures 16, 16.

Cases are fed from right to left on the case conveyor system 28 by means of relatively high speed side belts 54, to engage a retractable stop 52, such that the stop assures each case will be properly indexed with respect to the variable speed conveyor 50. As so constructed and arranged the apparatus of the present invention is adapted to handle articles in orderly groups and to deposit these articles into upwardly open packing cases without stopping the articles for drop packing as is characteric of present day drop packers generally. The cases are likewise moved continuously by the case conveyor, and are mated with the charges or slugs of articles dropped from the unique grid structures 16, 16 in a manner to be described in greater detail below.

Figure 2:
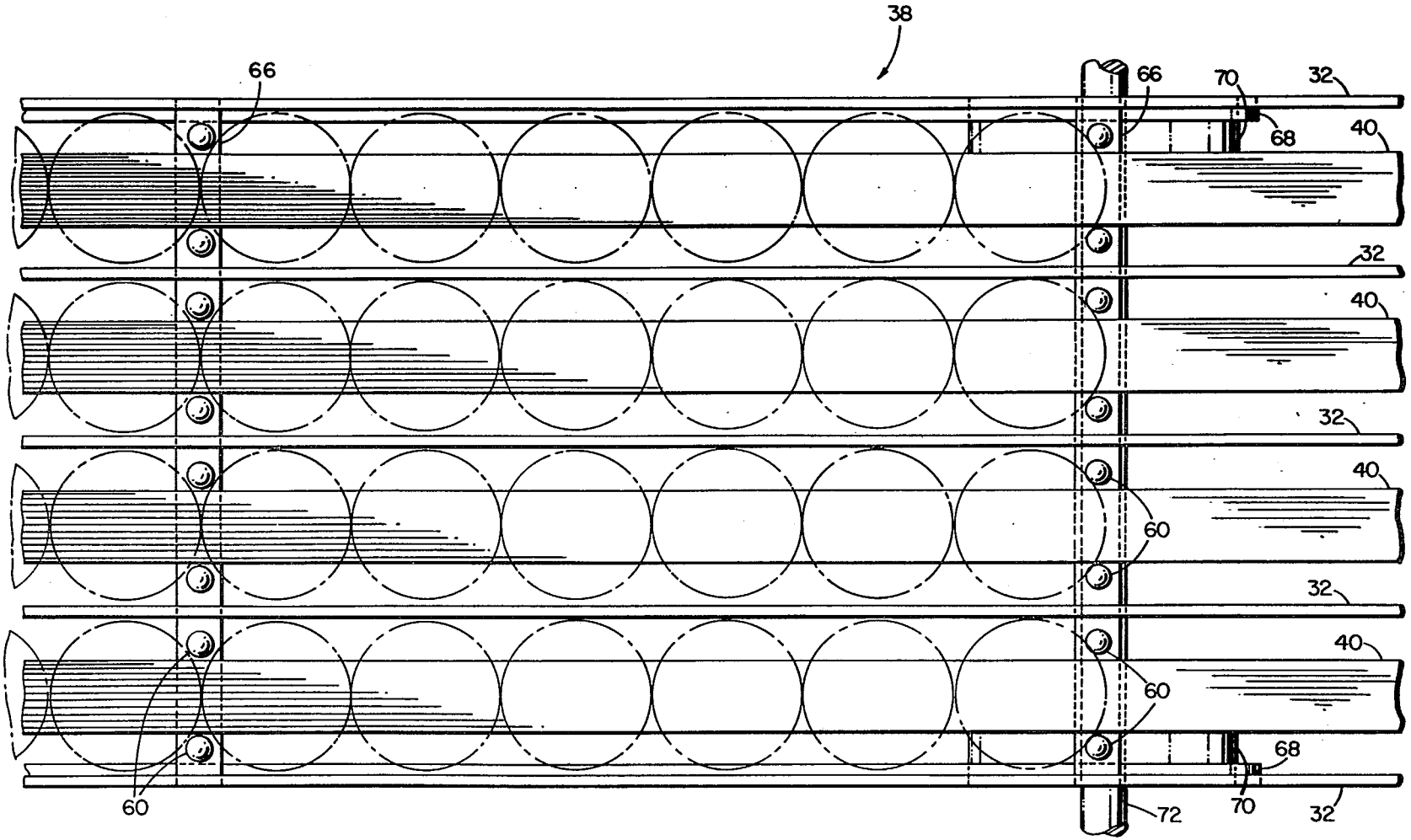
FIG. 2 is a plan view of a portion of the article conveyor means of FIG. 1, and more particularly of the means for grouping the articles in predetermined charges corresponding to the capacity of the cases to be packed.
Figure 3:
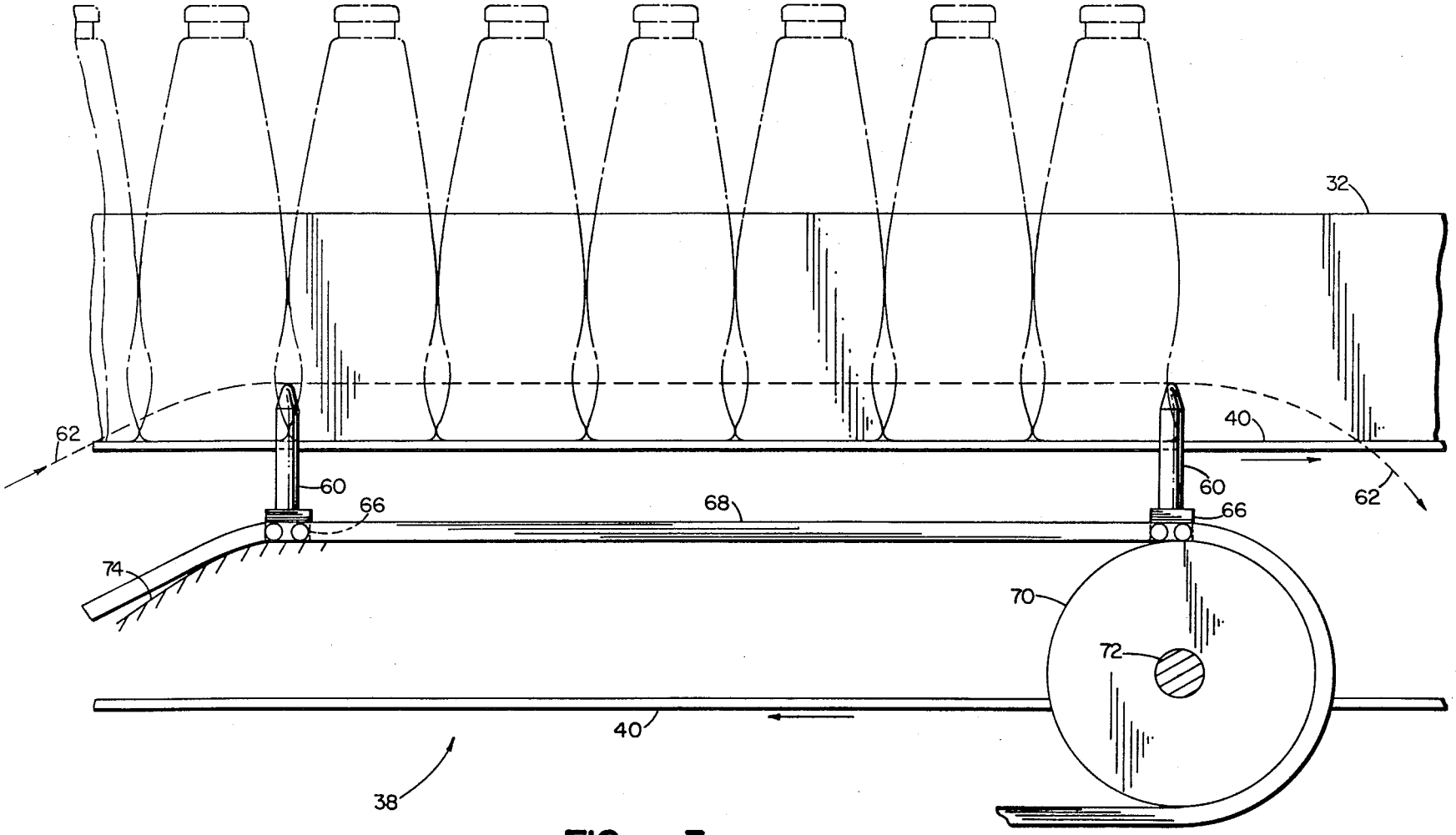
FIG. 3 is a side elevational view of the grouper means illustrated in FIG. 2 with the articles illustrated in phantom lines, and the path for the grouper pins shown in broken lines.

FIGS. 2 and 3 illustrated the means for grouping charges or slugs of articles on the individual lane conveyors 40, 40. Although FIG. 1 illstrates four by three charges or slugs of articles the remaining drawings will illustrate larger groups such as might be required to fill cases with a greater number of aarticles than is suggested in FIG. 1. For example, FIGS. 2 and 3 illustrate each group of articles as including four side-by-side columns, and each column having six articles for a total of twenty-four in a particular case. As mentioned previously the divider section 34 will have maneuvered the various articles from a nested configuration into individual side-by-side lanes so that line pressure of the articles moving in the direction of the arrow 30 in FIG. 1 serves to fill each of the individual lanes defined by the dividers 32, 32. Each lane has an associated conveyor 40 adapted to continuously urge the column of articles in the left to right direction as viewed in FIGS. 2 and 3.

The means for grouping the articles includes an underlying conveyor system best shown in FIG. 3 as comprising pin conveyors operated at a slightly slower speed of that of the individual lane conveyors 40. Each pin conveyor includes at least two pins 60, 60 adapted to move along the path indicated by the broken lines 62 so as to pass upwardly between the adjacent articles as suggested in FIG. 2 and to engage the forward portion of articles upstream thereof to slow their movement and to cause the underlying lane conveyor 40 to move at a slightly greater rate of speed so that a space is created between the slug of articles shown in FIGS. 2 and 3 and a preceeding slug which will have been accelerated downstream on the underlying conveyors 40, 40 for acceptance by the indexing Beans 42 to be described. As shown in FIG. 2 the pin conveyor comprises cross bars 66, 66 mounted to chains 68, 68 which chains are driven by sprockets 70, 70 so as to move the pins 60 in a closed path which includes an upper run as suggested in FIG. 3 to retain groups of the articles on the individual lane conveyors 40 and to decelerate them slightly until the pins 60 travel downwardly as suggested by the broken line 62 allowing the articles to again proceed at the speed of the lane conveyor 40. The pins 60 move up an inclined ramp defined in part by the cam surface 74 with the result that the upper ends of the pins 60, 60 move into the interstices between the adjacent articles without any tendency to upset the articles on the lane conveyors 40 but rather to simply slow the speed of the articles thereon in order to create the desired spacing between adjacent groups and to assure orderly transition of these groups of articles into the indexing means 42 to be described.

Figure 4:
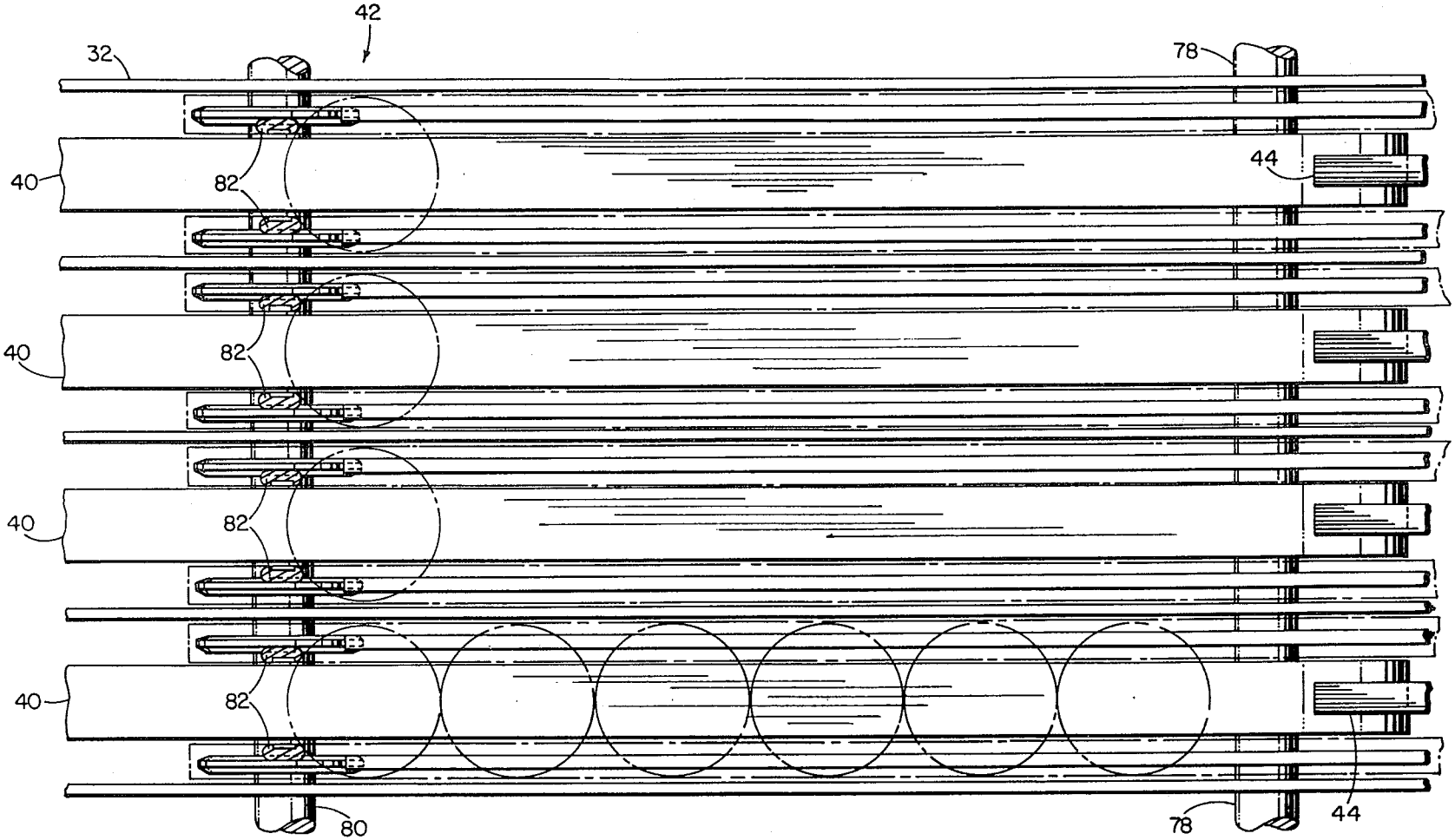
FIG. 4 is a plan view of the article indexing means provided downstream of the grouper means of FIG. 2 or 3.
Figure 5:
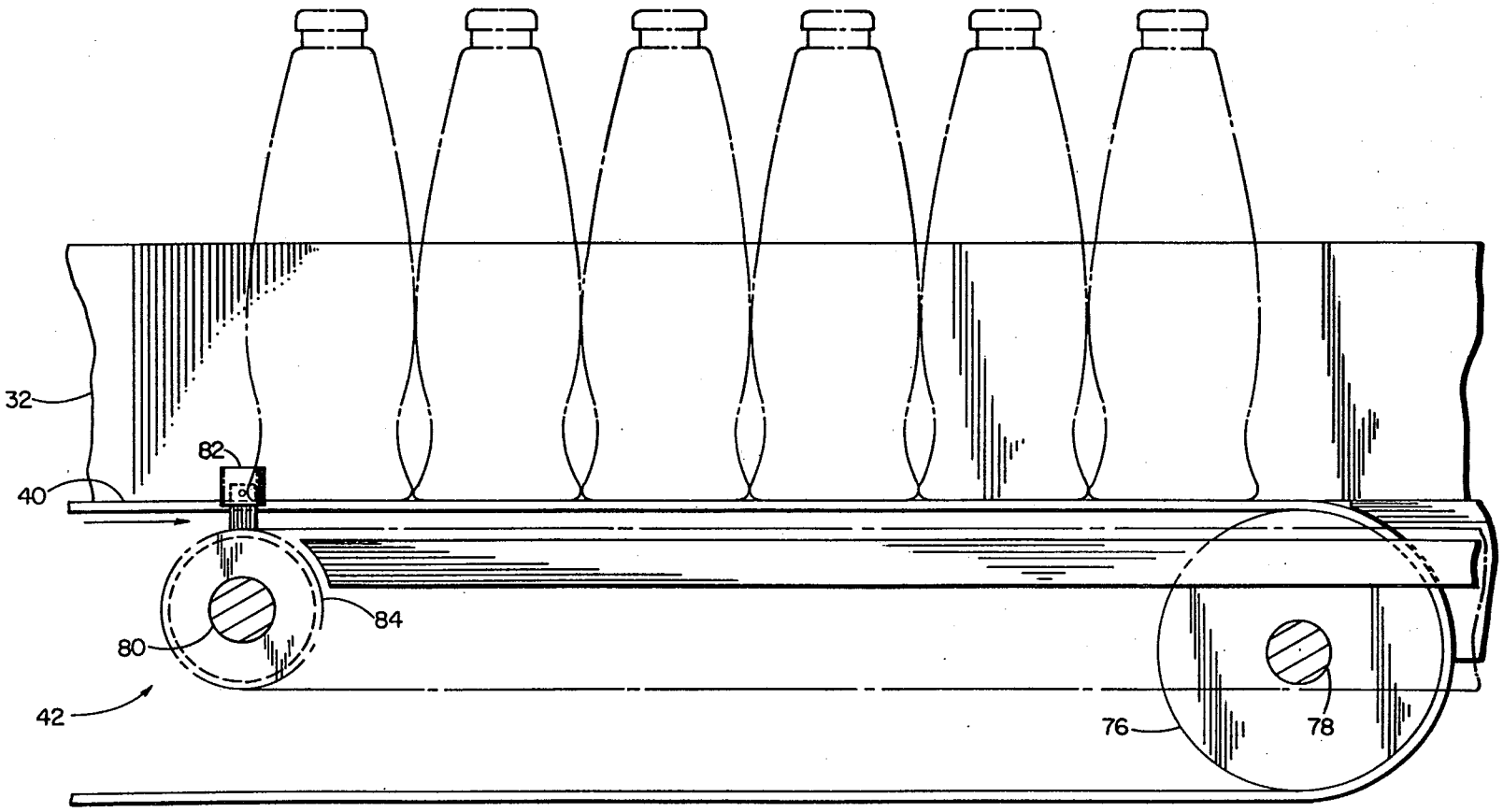
FIG. 5 is a side elevational view of the indexing means illustrated in FIG. 4.
Figure 6:
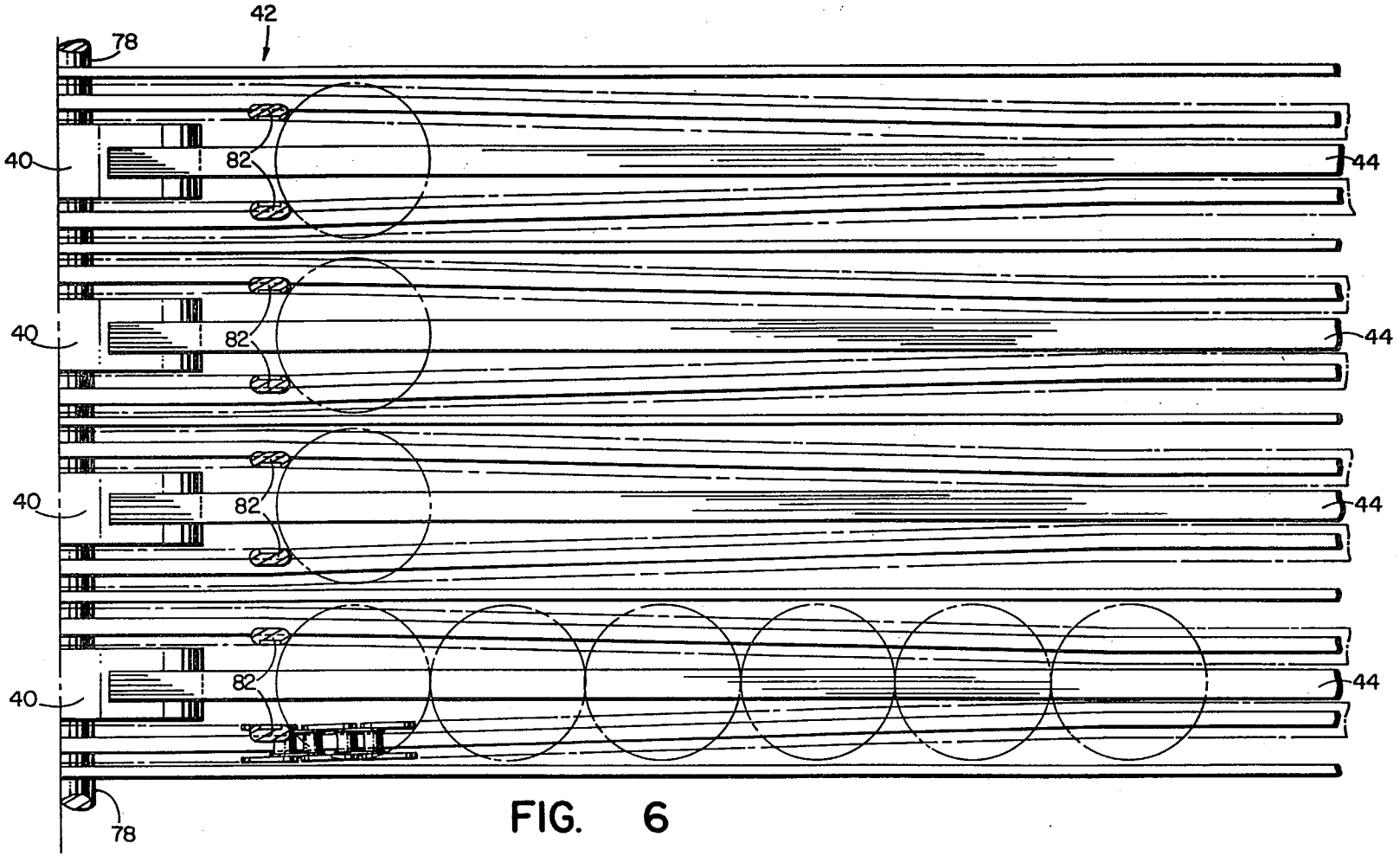
FIG. 6 is a plan view of a downstream portion of the indexing means just short of the infeed station.
Figure 7:
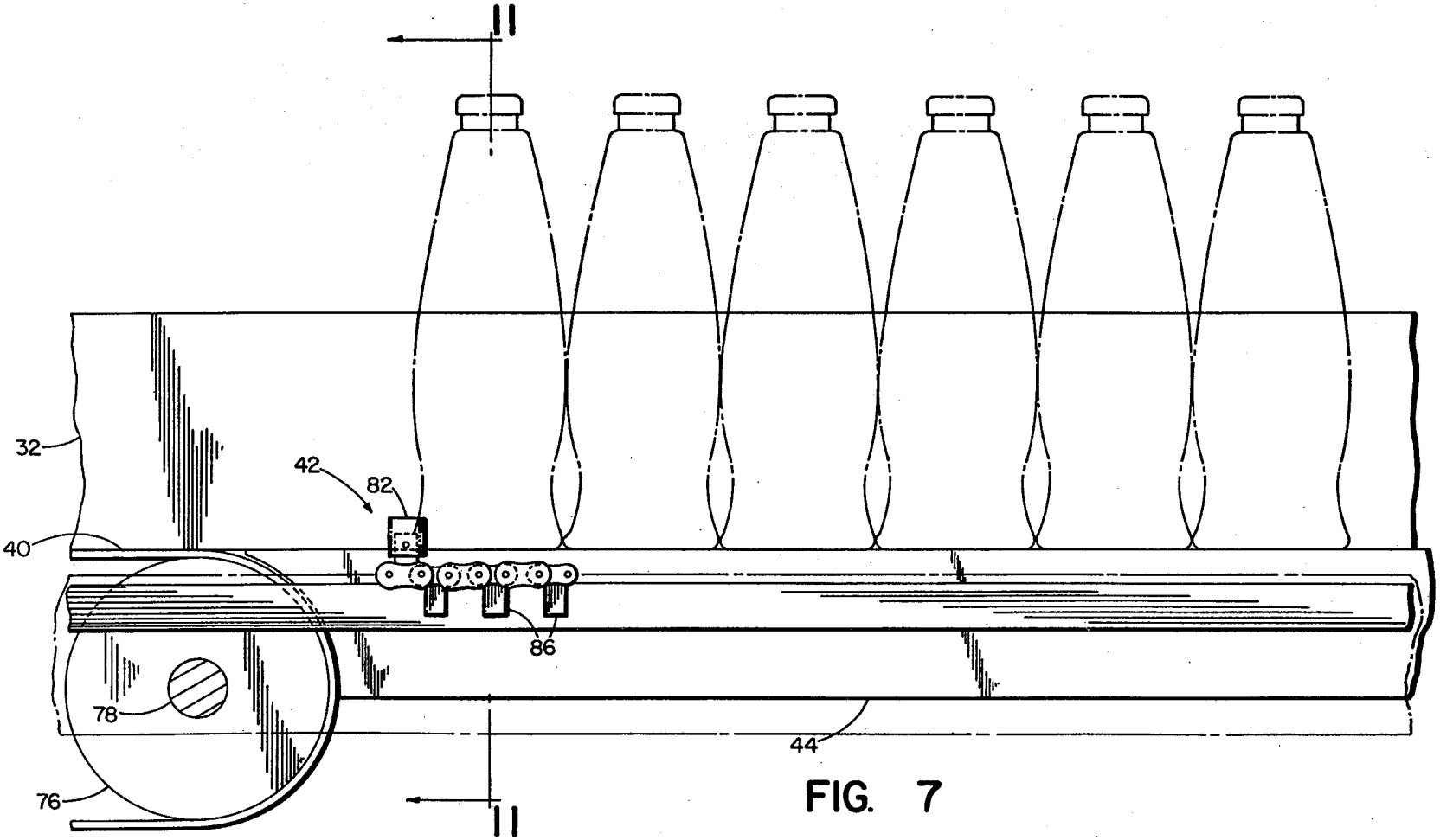
FIG. 7 is a side elevational view of the downstream portion of the indexing means illustrated in FIG. 6.

FIGS. 4 and 5 show an upstream portion of the indexing means 42, and FIGS. 6 and 7 illustrate the downstream portion thereof. These figures illustrate a cross shaft 78 which carries the drive means or pulleys 76 for operating the individual lane conveyors 40, 40. It will be apparent from a brief inspection of FIGS. 6 and 7 that the indexing means 42 serves to move each column of the charge or slug of articles from the downstream end of lane conveyor 40 onto one of a fixed set of cantilever mounted projecting fingers 44, 44 which fingers define horizontally extending openings therebetween, and which fingers extend in the downstream direction as illustrated in FIGS. 6 and 7 to also encompass the infeed station to be described with reference to FIGS. 8 and 9.

Figure 8:
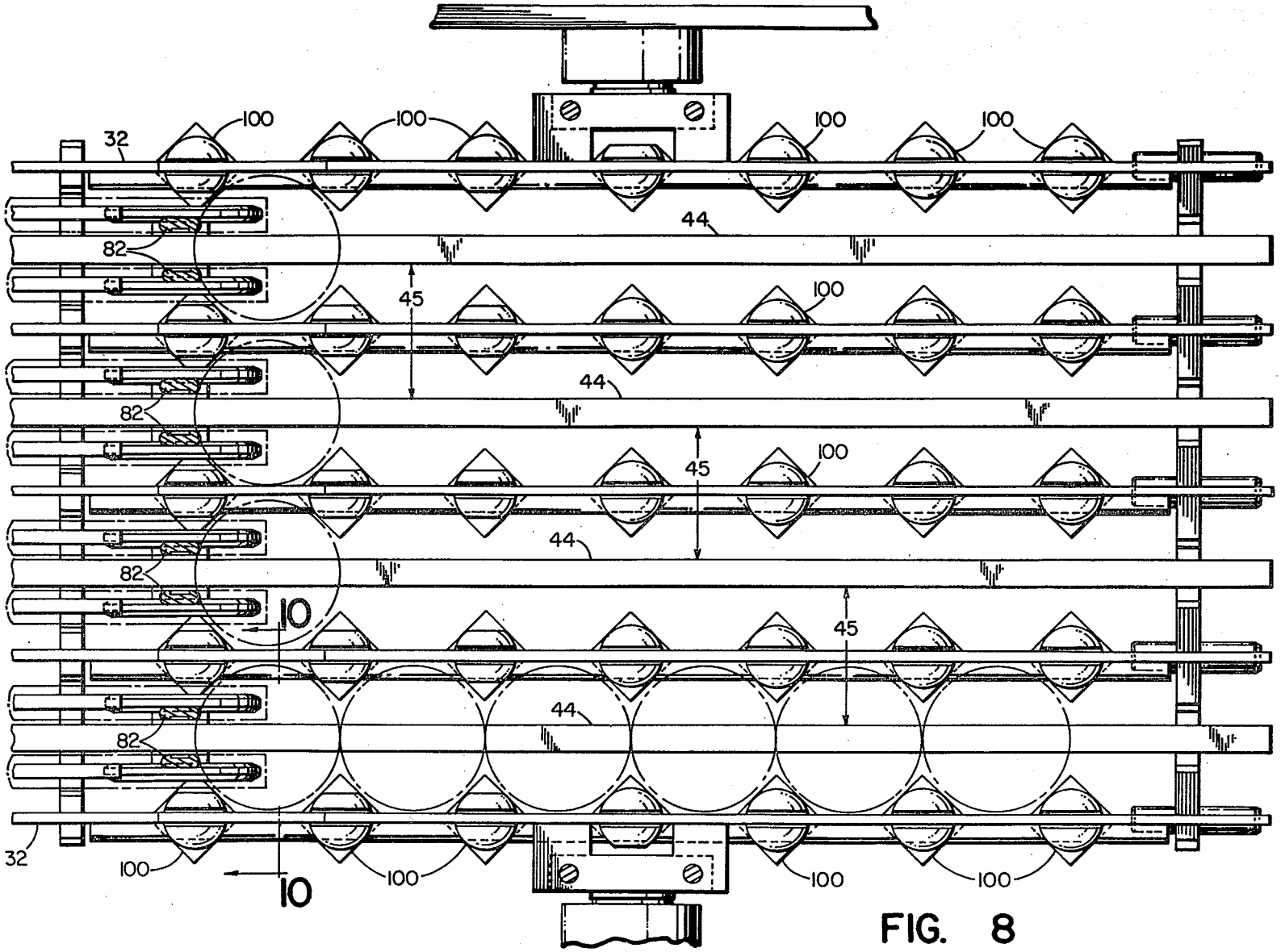
FIG. 8 is a plan view of the infeed station with a grid structure shown moving upwardly through this infeed station.

The indexing means 42 includes continuously driven article engaging pushers 82, 82 arranged in much the same manner as the group of pins 60 described previously in that two are provided in association with each of the individual lanes. These pushers 82, 82 are mounted on a chain as best shown in FIGS. 6 and 7, which chain passes over a sprocket 84 associated with cross shaft 80. Several such chains are provided, and each includes depending lugs 86, 86 which move in slots provided for this purposes adjacent the fingers 44, 44. These slots are tapered inwardly so as to move the pushers 82, 82 inwardly prior to entry of these pushers into the infeed station itself. As best shown in FIG. 8 the downstream end portion of the indexing means terminates just inside the infeed station, that is just inside the path of motion for the orbiting grid structure as the latter moves upwardly into the infeed station as mentioned previously. Thus indexing means 42 serves to accurately locate the groups of articles at the infeed station for pickup by the orbiting grid structures.

Figure 9:
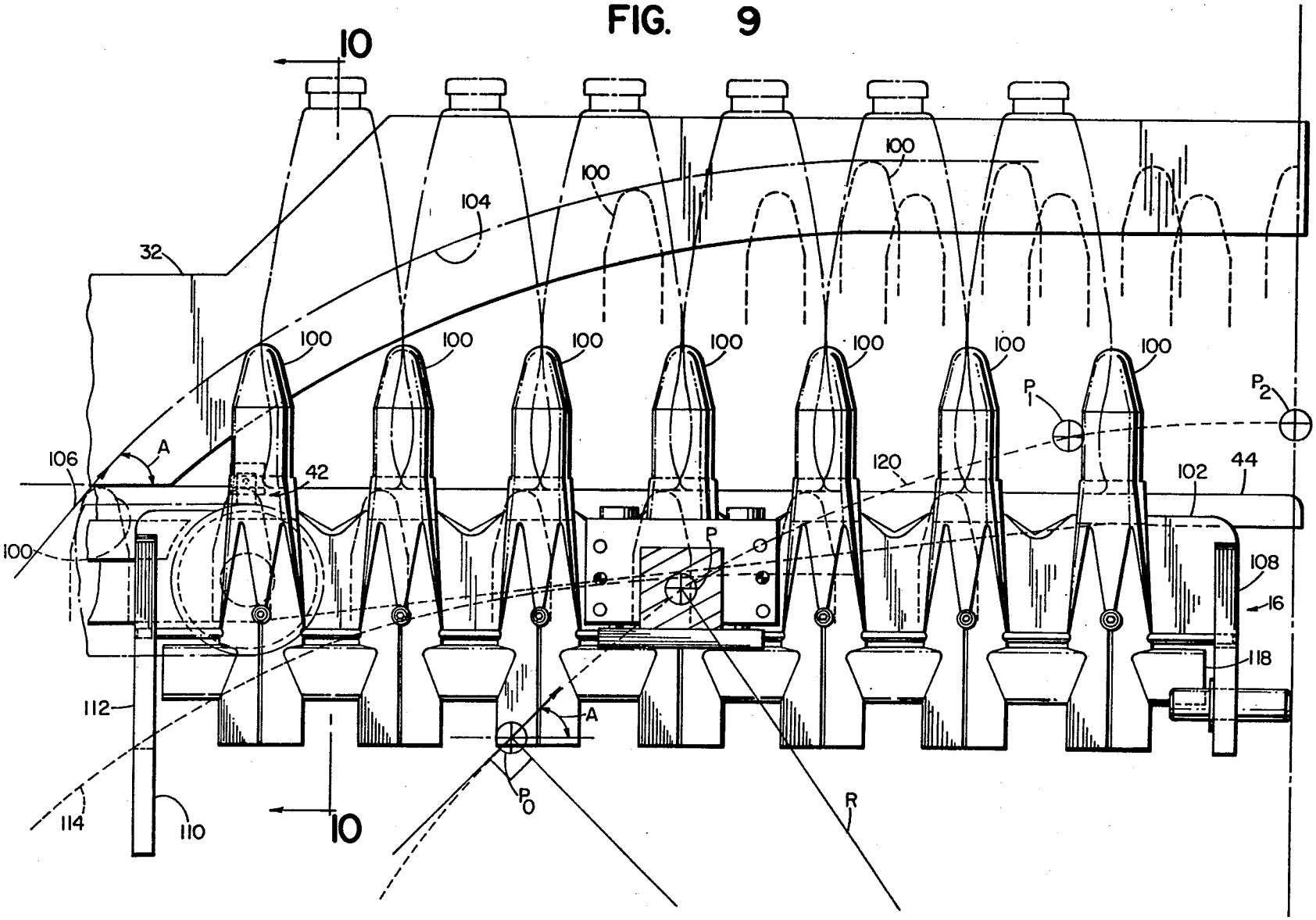
FIG. 9 is a side elevational view of the infeed station illustrated in FIG. 8, and includes alternative positions for the grid structure as it moves through the infeed station during its orbit as suggested by the broken lines of FIG. 9.

FIGS. 8 and 9 illustrate a grid structure 16 having moved upwardly into the infeed station so that the articles are provided between posts 100, 100 which posts carried by longitudinally extending support rails 102 in the grid structure. FIG. 9 also illustrates a series of positions for these posts 100, 100 and a phantom line 104 illustrates the path for the left-hand post or series of posts in the grid structure 16. It will be apparent from FIG. 9 that the upper end portion of this post 100 travels in the direction of the arrow 106 as it penetrates the horizontal plane defined by the bottom ends of the bottles on fingers 44, 44. This direction of the arrow 106 forms an angle A with this horizontal direction and it is an important feature of the present invention that this angle is preferably in the range between 30 and 45 degrees, but in no event less than zero degree or more than 60 degrees. Further, the horizontal speed for the articles as they move on the fingers 44, 44 by the action of pushers 42, 42 is closely matched to the horizontal component of velocity for the post 100 at the point where the upper ends of these posts penetrate the horizontal plane defined by the upper riding edges of fingers 44, 44. Angle A may for example be approximately 37 degrees in which case the ratio of the speed for the articles entering the infeed station and the tangential speed of the grid structure defined by the radius R and the rotation speed of the structure shown in FIG. 1 will be on the order of 0.8. That is, where this angle is between 45 and 30 degrees this ratio will be between 0.7 and 0.87. It has been found that this relationship gives the desired vertical penetration speed for the upper ends of the posts 100, 100 so that these posts enter between the articles as suggested in FIG. 9 and so that sufficient horizontal speed can be provided to match the horizontal speed of movement of the articles under the control of pushers 42, 42.

Figure 15:
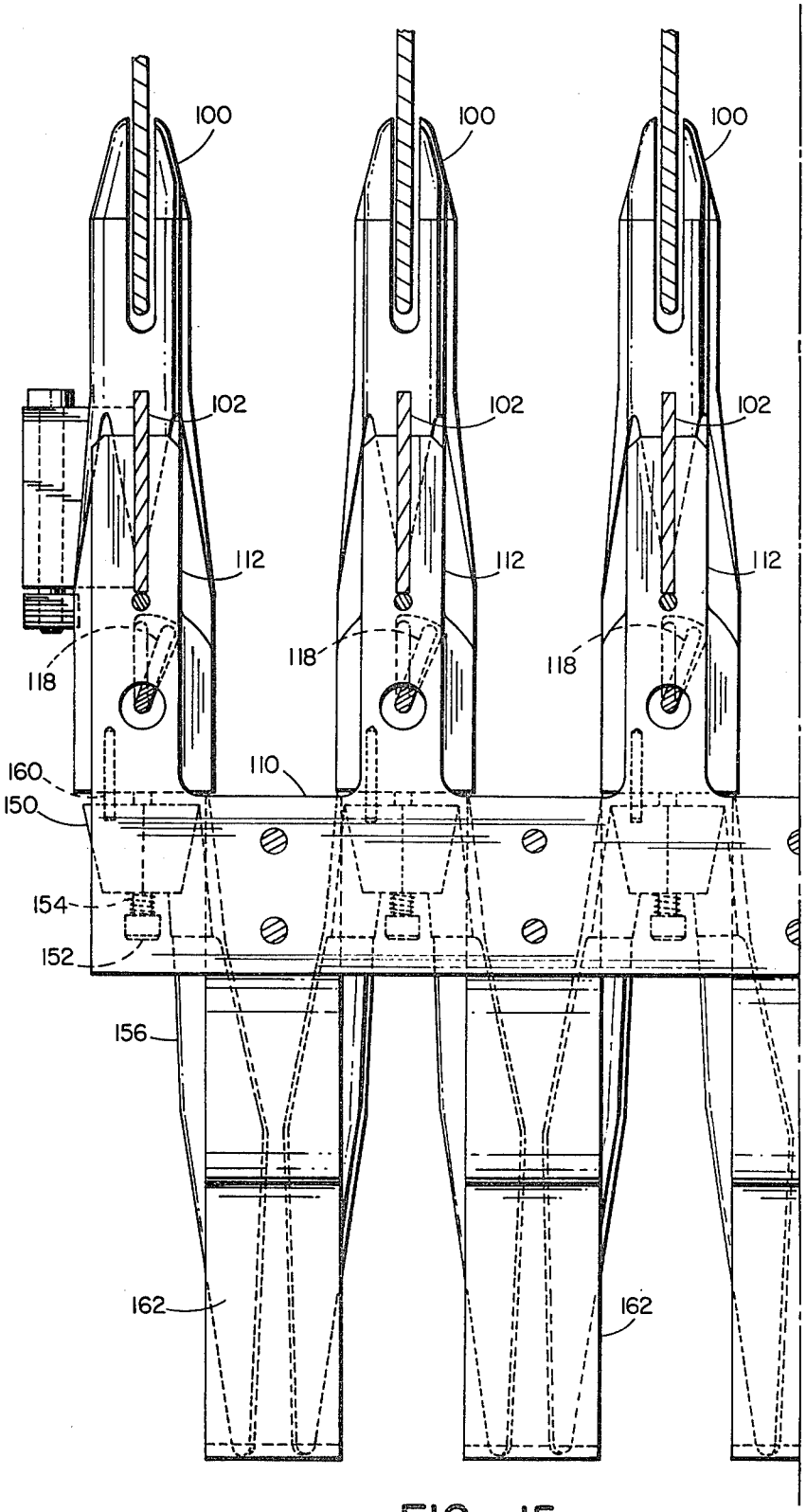
FIG. 15 is a left-hand end view of the grid structure shown in FIG. 12 being taken generally on the line 15—15 of that view.

The grid structure 16 will be described in greater detail hereinbelow, but for present purposes it should be noted that the longitudinally extending support rails 102, 102 are so mounted that the ends are supported in front and rear cross members 108, 110 respectively. The rear cross member 110 has upwardly projecting portions as best shown in FIG. 15 at 112 for so supporting the rear ends of the support rails 102. These upwardly projecting portions 112 move through the openings 45, 45 between the fingers 44, 44 so that the lower portion 110 of the rear cross member remains beneath the underside of the fingers 44, 44 as suggested by the broken line 114 in FIG. 9. Still with reference to FIG. 9 it should be noted that the grid structure 16 includes longitudinally extending vanes 118, 118 provided below the cross rails 102 and pivotally mounted at opposite ends in the cross members 108 and 110 respectively. These vanes 118 have upper edges which are adapted to be moved from and to positions for supporting the articles as suggested by the broken lines in FIG. 13. The articles are lifted from the fingers 44 as a result of orbital movement of the grid structure 16, from the solid line position shown, to the point where the pivot point P for the grid structure 16 moves from the position indicated for it at P1 to that at P2. It is only at this phase of movement for the grid structure 16 that the articles will be lifted from the fingers 44 to be supported solely by the upper ends of vanes 118, 118 as suggested in FIG. 13. Thus, broken line 120 illustrates the path of movement for the pivot point of the grid structure 16 and in position P the grid structure will be so oriented that the upper ends of corner posts 100 are just entering the horizontal plane defined by the upper edges of fingers 44, 44.

Figure 12:
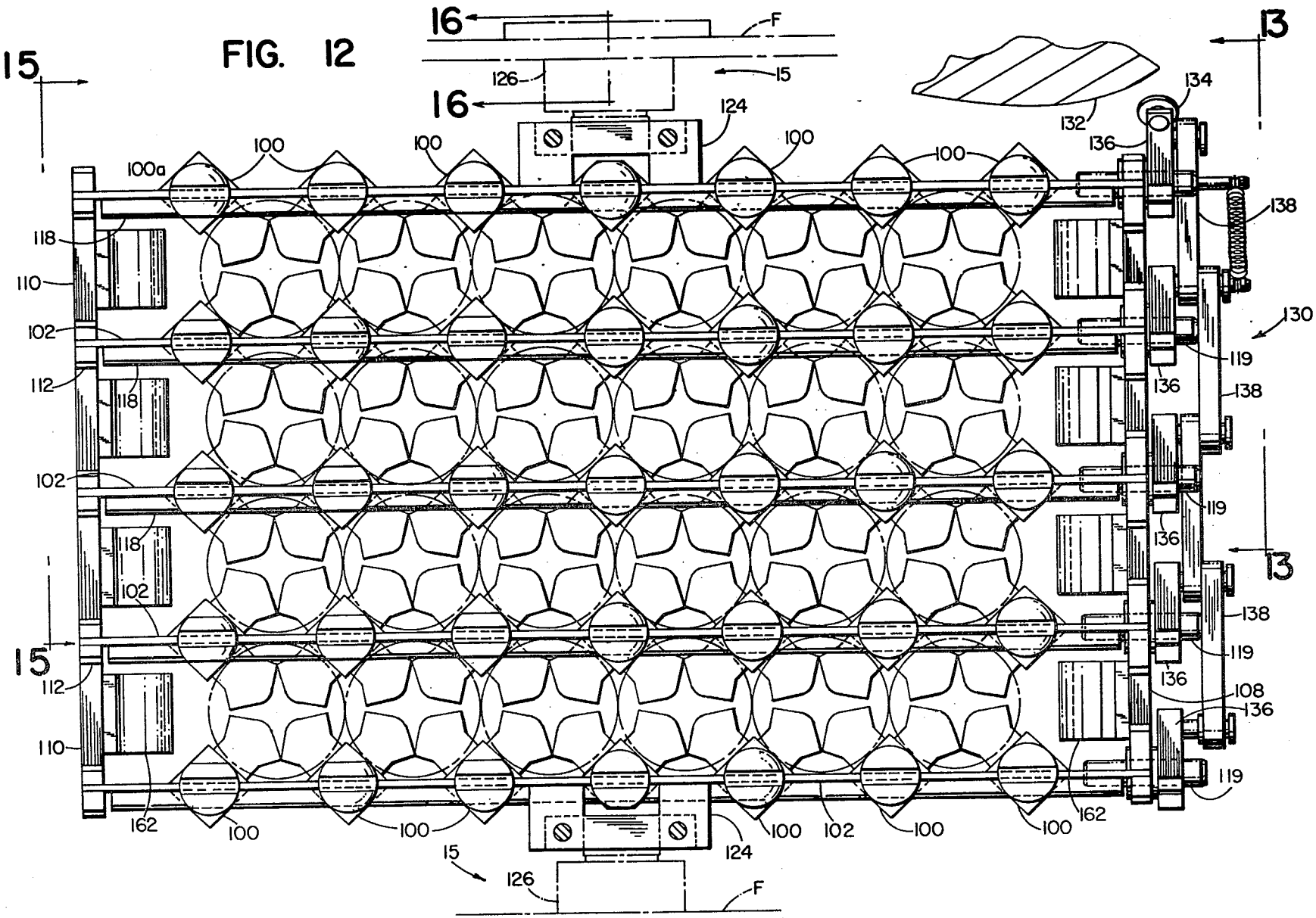
FIG. 12 is a plan view of one grid structure with reference to the means for pivotally supporting the grid structure from the orbital mechanism and also illustrates a cam suitable for operating the vanes within the grid structure to drop articles into a packing case at the discharge station. The articles are illustrated in phantom lines as are the mountings for the grid structure itself.
Figure 14:
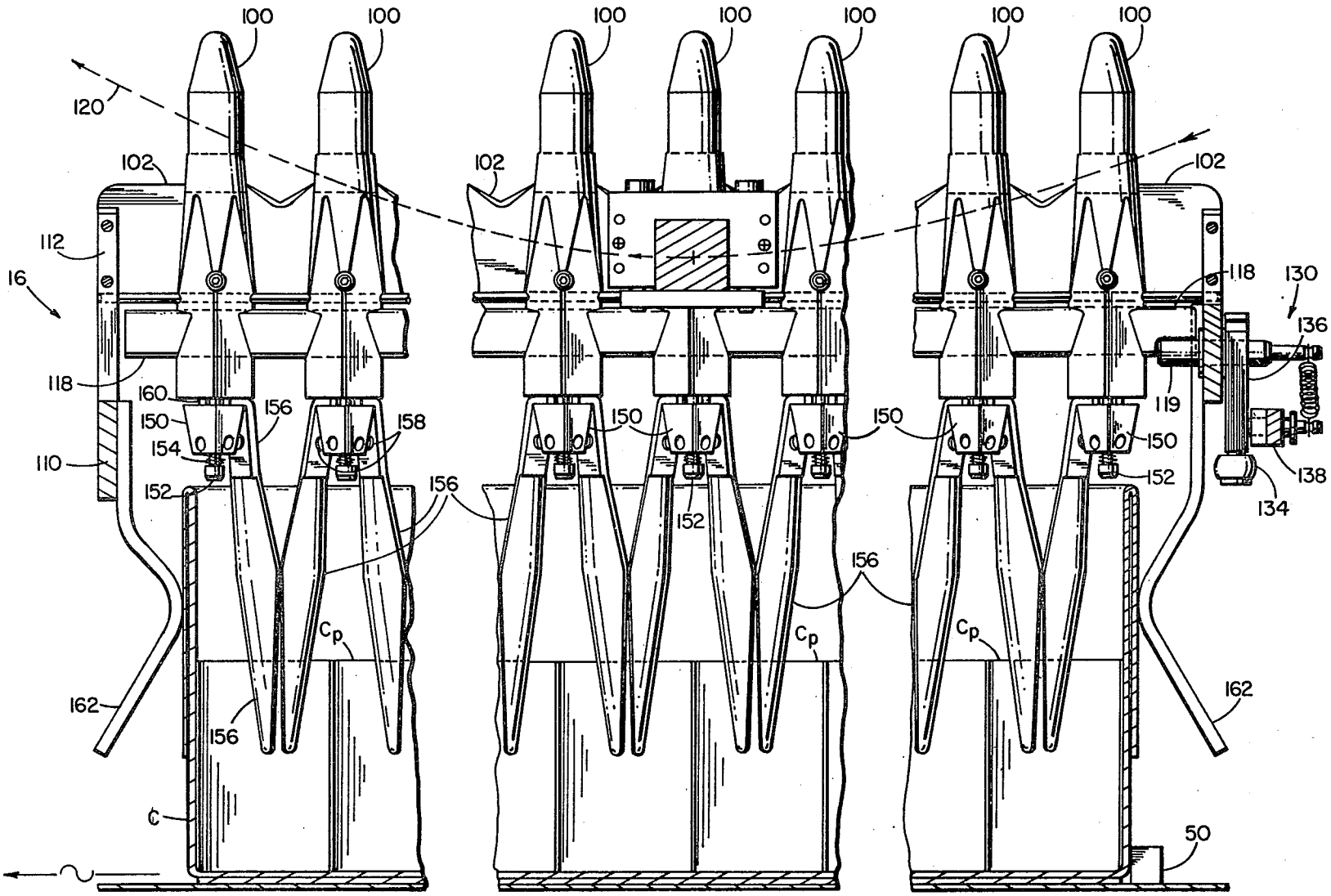
FIG. 14 is an elevational view of the grid structure illustrated in FIG. 12, and this view also illustrates the path of motion for the grid structure through the discharge station together with the underlying case conveyor and case carried thereby.

FIG. 12 illustrates the grid structure without relation to the fixed structure of the infeed station, and instead shows the grid 16 at the lower side of the orbit illustrated for the grids of figure. More particularly, this FIG. 12 view provides a plan view of the grid structure located at the discharge station. FIG. 14 illustrates the grid structure of FIG. 12 in elevation, and also shows the relationship between this continuously moving grid 16 and the case C to be filled, together with the variable speed case conveyor with one of the several pusher 50 associated therewith. The grid structure 16 moves generally in a circular orbit or path as illustrated at 120 in FIG. 14, and as mentioned previously the grid 16 is maintained in a horizontal relationship as it moves around this circular orbit as a result of chains or belts 18, 18 provided for this purpose in the grid moving means. As shown in FIG. 12 the outside support rails 102, 102 of the grid are provided with blocks 124, 124 which blocks are rotatably supported in bearings 126, 126. Each bearing 126 receives a shaft (not shown) which shaft has a sprocket or pulley for belts 18, 18 to maintain the grid structure in a horizontal orientation as it travels in its orbit and in a generally vertical plane as described previously with reference to FIG. 1.

Figure 10:
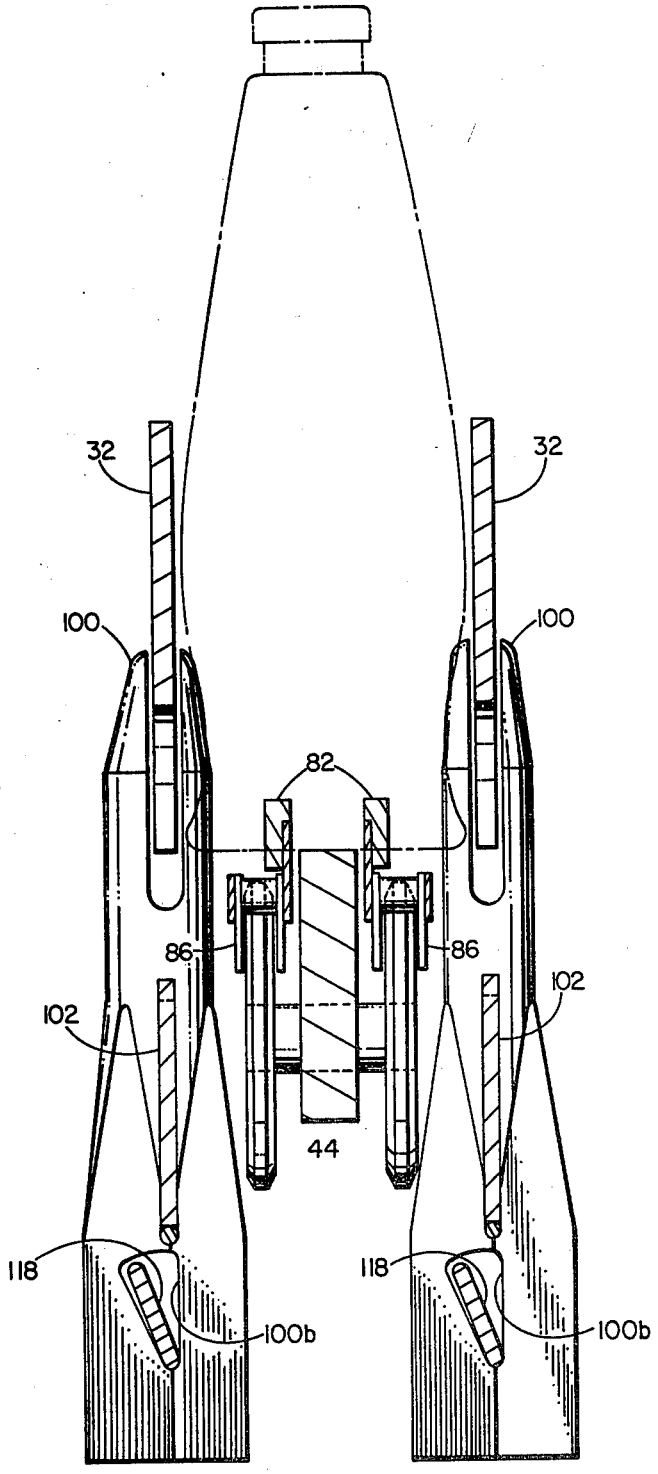
FIG. 10 is a sectional view taken generally on the line 10—10 of FIG. 8 and FIG. 9.
Figure 11:
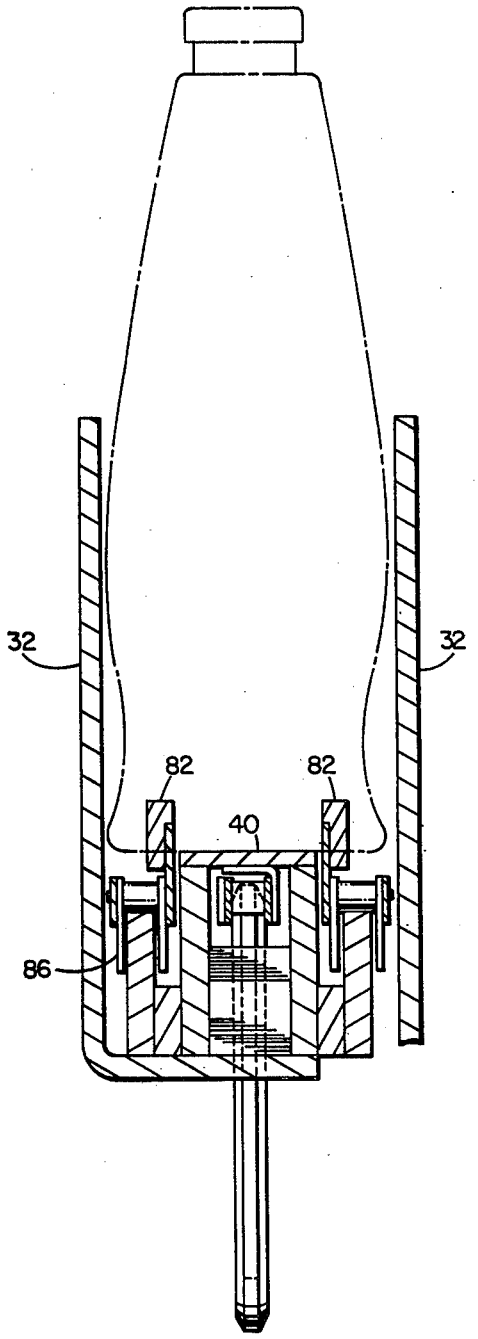
FIG. 11 is a sectional view taken generally on the line 11—11 of FIG. 7.

FIG. 12 illustrates the configuration of each pocket in the grid structure for receiving the various articles in a group of articles to be packed. The corner posts 100, 100 have upper end portions which are slotted as shown at **100*a* in FIG. 13 in order to be received by the underside of the lane divider 32 as suggested in FIG. 9. These corner posts are preferably fabricated from a plastic material and are anchored to the cross rails or support rails 102 referred to previously with reference to the grid structure 16. Each corner post 100 has a lower end portion adapted to receive a pivotally mounted vane 118 as shown to be best advantage in FIG. 10. The openings 110*b* for these vanes in the corner posts 100 are of generally triangular configuration to allow for the desired degree of pivotal movement for the vanes 118**.

Figure 13:
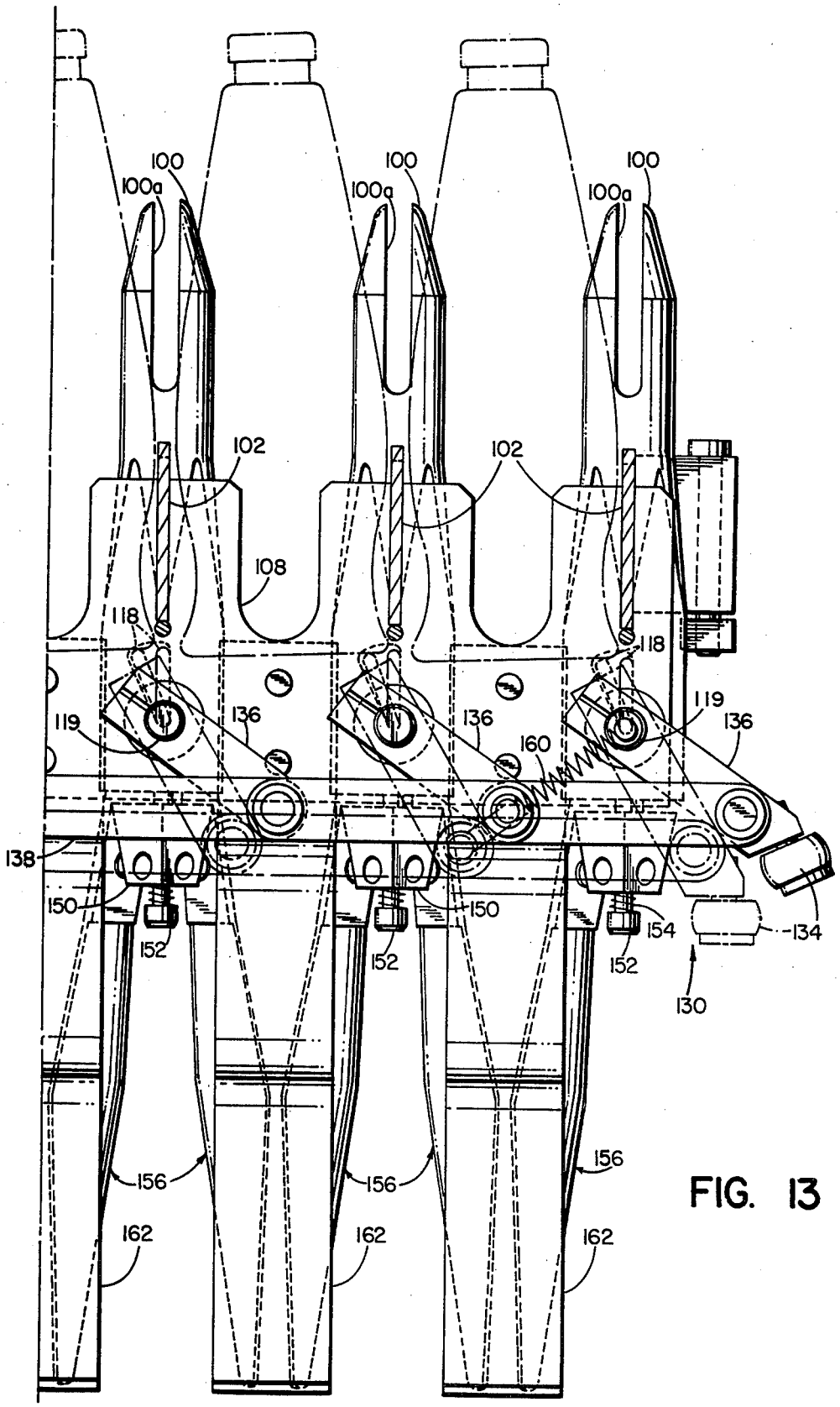
FIG. 13 is a right hand end view of the grid structure illustrated in FIG. 12 being taken on the line 13—13 of that view.

The mechanism for moving these vanes is illustrated generally at 130 in FIGS. 12, 13 and 14. A fixed cam 132 is provided adjacent to the discharge station 46 and is adapted to be engaged by a cam follower roller 134 such that the lever arm 136 upon which the cam follower roller 134 is mounted can move from the solid line position shown for it in FIG. 13 to the broken line position shown for it in that view. Several such links 136, 136 are provided on each of the pivot shafts 119, 119 which carry the vanes 118 and these links 136 are interconnected by parallel links 138, 138 best shown in FIG. 12. This construction assures that each of the vanes 118, 118 will be moved between the positions shown for them in unison with one another all in response to engagement between the cam surface 132 and the cam roller 134.

As mentioned previously the articles are supported on the upper edge of the vane 118 and once the vane 118 is pivoted as described above these articles will drop downwardly through the pockets and through a funnel structure best shown in FIG. 14. The funnel structure comprises individual fingers at the corners of each of the pockets and each finger comprises a resilient plastic part retained at the lower end of the post 100 by retaining means in the form of a spring biased block slidably supported on a single threaded stud 152 which stud is threadably received in the lower end of the corner post 100. A small spring 154 is provided to urge the retaining member 150 upwardly and to retain the upper end of finger 156 between the lower end of the corner post 100 and the upper end of the retaining means 150. Additional springs 158, 158 may be provided to urge the resilient fingers 156 toward one another in each associated pocket as best shown in FIG. 12. The finger retaining member 150 is preferably non-rotatably mounted on the threaded screw 152 and pins 160 may be provided for assuring that the fingers remain in proper orientation with respect to their associated pockets.

The grid structure 16 of FIG. 14, as mentioned previously, will move generally along the direction of the line 120 in its circular orbit as it passes through the discharge station where the articles are released for gravity free fall between the resilient fingers 156, 156 into the packing case C on the case conveyer 50. The horizontal component of velocity for the grid structure 16 does vary sinusoidally as a result of the circular orbit for the grid structure 16 and it is a feature of the present invention that the case conveyor 50 is advanced at a variable speed with a sinusoidal variation in velocity so that its speed is matched to that of the grid structure 16. In order to further insure that the grid structure 16 is properly indexed with the case C to be filled guide means 162, 162 are preferably provided in the grid structure to assure that the case C is properly located on the case conveyor for this purpose. As so constructed and arranged the fingers 156 will penetrate the case, and actually penetrate the partitions Cp within the case C and thereby assure a positive degree of control over the articles being packed.

Figure 19:
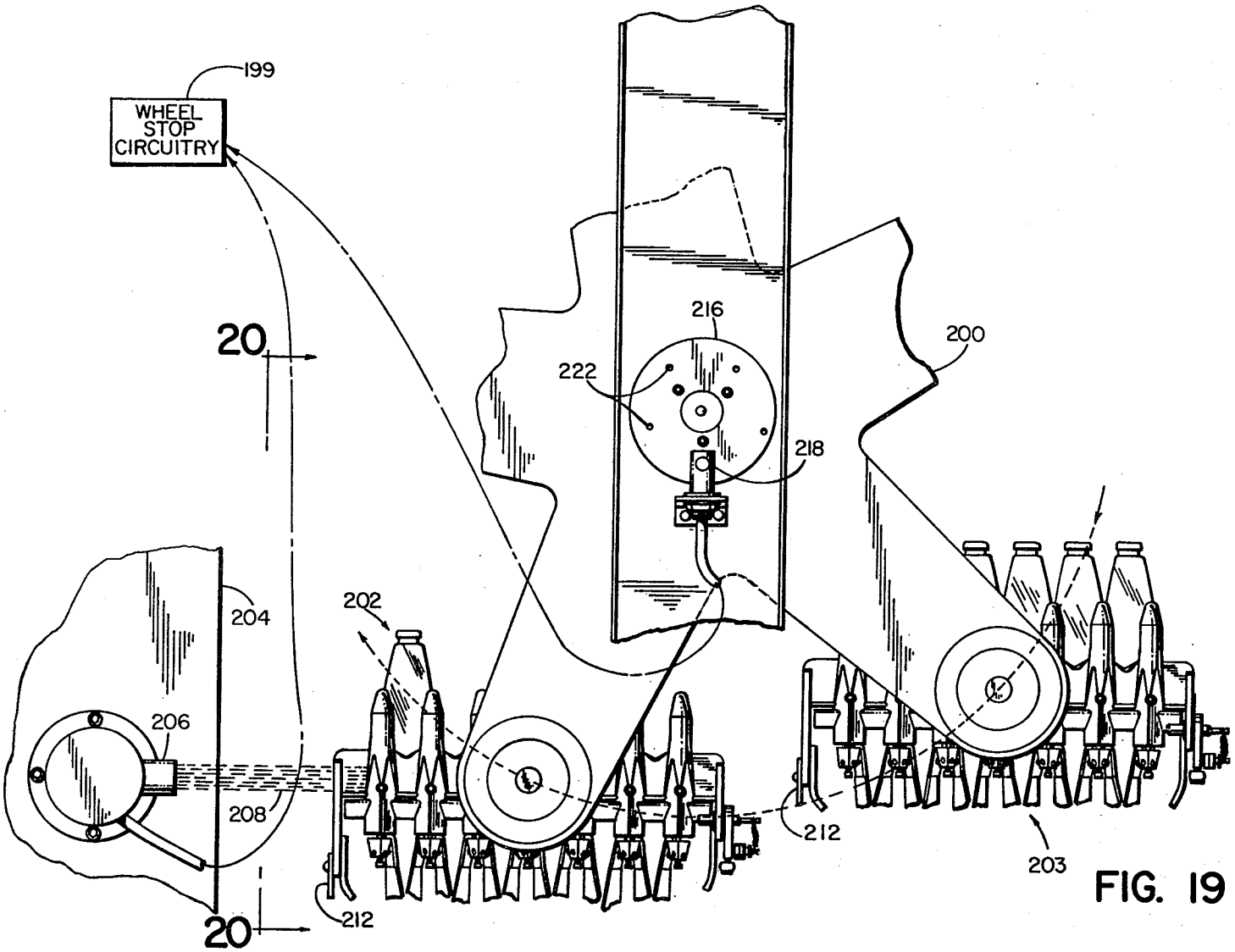
FIG. 19 is side elevational view of an alternative form for the means for moving the grid structures in orbit through the discharge station, and shows two of five grids in positions immediately before and after the articles are discharged such that the "empty" grid can be inspected for the presence of a hung up article.
Figure 20:
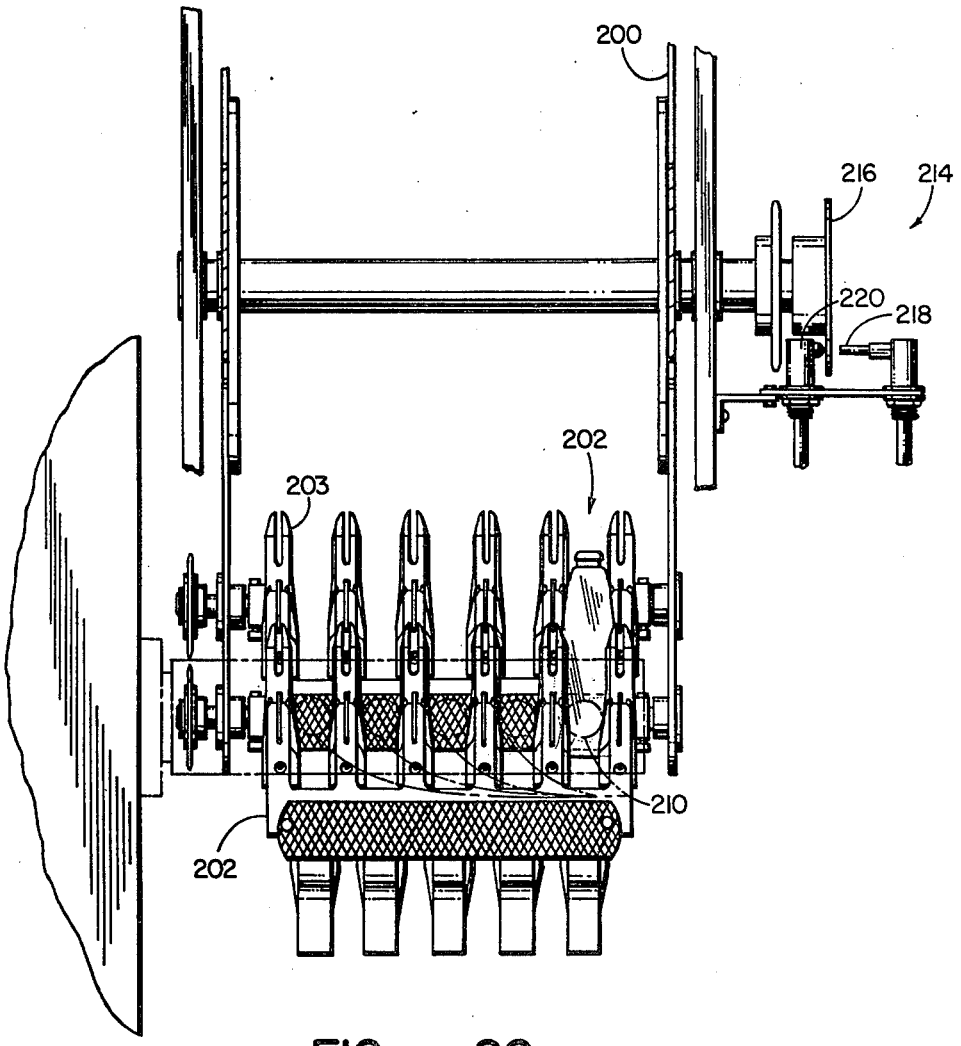
FIG. 20 is a vertical sectional view taken generally on the line 20—20 of FIG. 19.

Referring now to FIG. 19, wherein a five grid support structure is shown, once each grid has moved through this discharge station as described above, the spider shaped wheel structure 20 will continue to move the grids in a circular orbit so that each grid moves through the discharge station to the position shown at 202. A photocell/light beam detector array is mounted in the machine frame 204 for indicating, at this predetermined position of the grid between the discharge and the infeed station, whether one or more articles have failed to drop from their positions on the several grid vanes. Stop circuitry 199 disables the grid drive means through a brake (not shown) when a hung-up article such as shown at 202 fails to fall from its position on one of these grid vanes. These photocells (and light source) units 206 cause a beam 208 of light to pass through each of the grid lanes (as shown at 210 in FIG. 20) to be reflected by reflectors 212 provided on each grid back to the photocell when no article has been hung-up in the grid. Whenever a light beam fails to be so returned to the photocell the stop circuit activates the brake to prevent damage to the articles at the infeed station. FIG. 20 shows the means 214 for timing this photocell detection device to provide such safety feature precisely when the succeeding grid 203 is in the FIG. 19 position. A disc 216 rotates with the spider when structure supporting the five grids 202, 203 etc. and a fixed light source 218 is provided on one side of the disc to direct a light beam to a photocell 220 when one of five holes 222, 222 permits the beam to pass through the disc 216. The wheel stop circuitry 199 provides a stop signal to the wheel drive mechanism when all photocells fail to provide input signals to the stop circuitry. The drive mechanism for the spoked wheel preferably includes a one-way clutch which is set to slip at a predetermined torque load.

Figure 17:
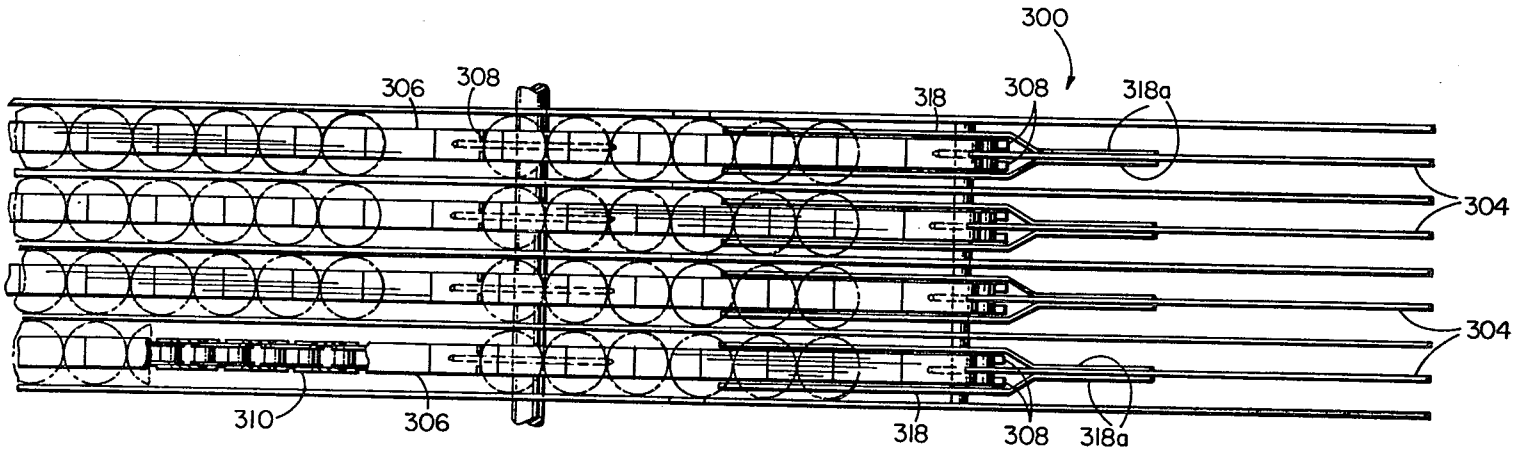
FIG. 17 is a plan view of an alternative form of the article indexing means depicted in FIGS. 4 and 6.
Figure 18:
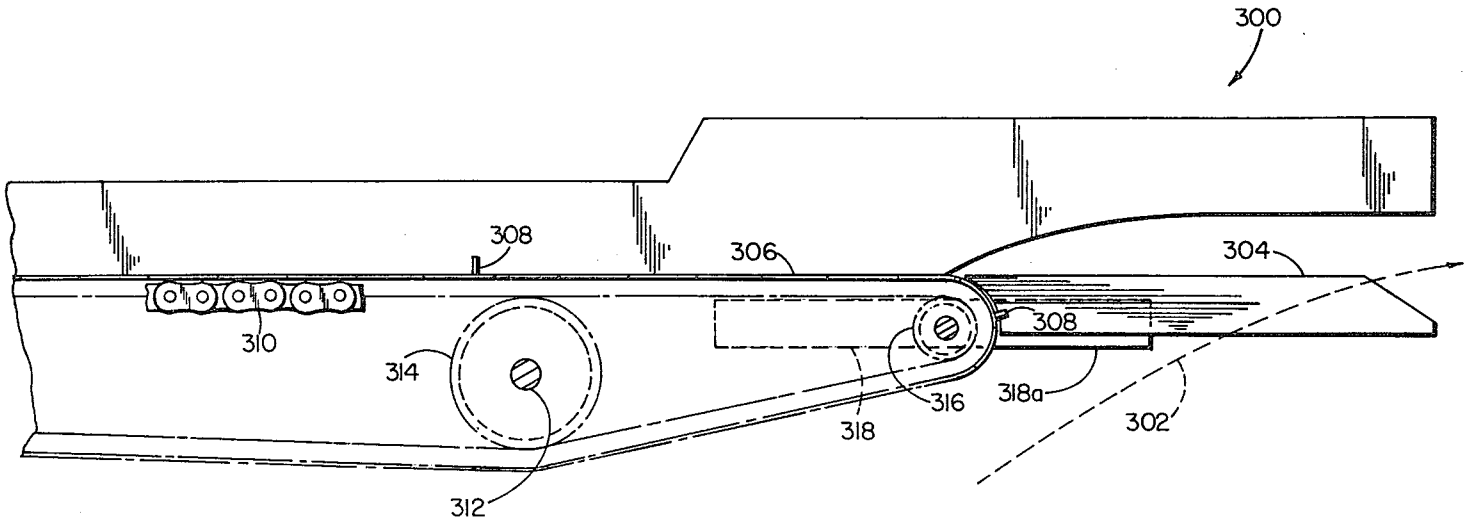
FIG. 18 is a side elevational view of the indexing means illustrated in FIG. 17 being an alternative form to that depicted in FIGS. 5 and 7.

FIGS. 17 and 18 illustrate an alternative form for the article indexing means downstream of the grouper means described above. It will be apparent that other forms for the grouper means may be provided also, but the indexing means of FIGS. 17 and 18 represents a significant improvement over that described in FIGS. 4–7 inclusively.

The infeed station 300 of the FIGS. 17, 18 version is similar to that described above in that grid structures (not shown), but identical to those described above, move upwardly through openings defined by the cantilever supported fingers 304, 304. These grids move in an orbit and are held horizontal during orbital movement as mentioned previously.

In FIGS. 17 and 18 version the article groups do not move along belt type lane conveyors as described above with reference to the embodiment of FIGS. 4–7. As shown in FIGS. 17 and 18 the lane conveyors comprise individual chain driven plate conveyors 306, 306 with pins 308 provided at spaced locations to index the article groups fed to the infeed station 300. Each such conveyor 306 is driven by a single chain 310 as shown from a single drive shaft 312 and sprockets 312, 312 associated with each conveyor chain.

This configuration for the article engaging pins or pushers 308 provides for closer spacing for these pins as they pass downwardly around the small sprockets 316 on either side of the finger 304 (See FIG. 17). Each finger is conveniently supported in a yoke structure 318 having upstream legs mounted to the machine frame below the upper run of conveyor 306, and having downstream legs **318*a*, 318*a* spaced closely to accommodate and support the finger 304 therebetween. As a result of this compact configuration for the pins 308 and the finger supporting structure 318 and 318*a* the openings defined between the fingers are better adapted to accommodate the upwardly moving grid structures than is true of the article indexing means and finger support structure described above with reference to FIGS. 4–7**.

We claim:

1. A packer for depositing groups of articles in upwardly open packing cases and comprising:

conveyor means for advancing articles continuously in side-by-side columns along a first horizontal path so that these articles are arranged in end-to-end relationship and in predetermined groups corresponding to the capacity of the cases, means defining an infeed station at the downstream end of said conveyor means and including fixed cantilever mounted fingers for slidably receiving said columns of articles, said fingers being spaced laterally to define horizontally extending openings therebetween, a plurality of grid structures, each grid structure defining individual upwardly open article receiving pockets, said pocket defining grid structure including upwardly projecting pocket corner posts and support rails to which said posts are mounted in longitudinally spaced relationship, each grid structure including article support means movably mounted for supporting articles in said pockets in one position and for releasing articles in a second position for said article support means, means for moving said grid structures continuously in a closed orbital path such that said posts move in a vertical plane and through the horizontal extending openings defined by said spaced fingers at said infeed station, said orbital path having a horizontal component of velocity at said infeed station which component is closely matched to the horizontal speed of the articles at least as said posts move upwardly through said horizontally extending openings said orbital path for said grid structures including a discharge station spaced from said infeed station, and means for moving said article support means from support to release position at said discharge station.

2. The packer of claim 1 wherein said discharge station spaced from said infeed station is located below said infeed station at a location in said closed orbital path where the velocity of the grid structure is substantially horizontal.

3. The packer of claim 2 further characterized by case conveyor means for moving cases along a path below said grid structure at said discharge station and at a speed closely matched to the horizontal velocity of the grid structure.

4. The packer of claim 1 wherein each grid structure includes front and rear cross members for supporting the front and rear ends respectively of said support rails, said rear cross member having upwardly projecting portions for so supporting the rear ends of said support rails, and said rear cross member having a lower portion extending laterally below said article support means in said grid structure, and said closed orbital path for said grid structure movement through said infeed station defining an arcuate path for each grid structure such that said rear cross member's lower laterally extending portion passes below said fixed cantilevered fingers.

5. The packer of claim 4 wherein said article support means in each grid structure comprises pivotally mounted vanes provided below said support rails, said vanes in said second or release positions being located in the same plane as the support rails and in said one or support positions said vanes having their upper marginal edges projecting out of the planes of said support rails at least between said posts to prevent articles from dropping downwardly through said pockets.

6. The packer of claim 5 wherein said discharge station for each grid structure is located below said infeed station in said orbital path at a location where the velocity of the grid structure is substantially horizontal.

7. The packer of claim 6 further characterized by case conveyor means for moving cases along a path below said grid rstructure at said discharge station and at a speed closely matched to the horizontal velocity of the grid structure.

8. The packer of claim 1 further characterized by said orbital path for said grid structures comprising a circle oriented in a vertical plane, and means for maintaining said grid structures in generally horizontal parallel relationship with respect to one another as they move in said circular orbit.

9. The packer of claim 8 further characterized by means for moving said grid structures in said circular orbit at a constant angular velocity such that the tangential speed of said individual grid structure is greater than the speed of said articles advancing horizontally into said infeed station along said first horizontal path.

10. The packer of claim 9 wherein said horizontal path of articles advanced into said infeed station forms an angle A with the instantaneous tangential direction of movement of the grid structure entering said infeed station and where said angle A is less than 60 degrees but greater than zero degrees.

11. The packer of claim 10 further characterized by fixed lane dividers associated with said article conveyor means and confining said articles advancing into said infeed station to movement in side-by-side columns, said article conveyor means comprising individual lane conveyors for frictionally engaging the bottoms of articles in each lane to urge the articles in the downstream direction, said fingers being aligned with downstream ends of said lane conveyors to slidably receive the articles as they enter said infeed station, and said lane dividers having downstream end portions to guide the articles at said infeed station.

12. The packer of claim 11 further characterized by grouper means associated with each of said individual lane conveyors, said grouper means comprising continuously driven article engaging conveyors operated at a slightly slower speed than that of said individual lane conveyors.

13. The packer of claim 12 further characterized by indexing means associated with each of said individual lane conveyors and located downstream of said grouper means, said indexing means comprising continuously driven article engaging pushers to move the groups of articles between said lane dividers and beyond said lane conveyors onto said fingers to precisely locate each group in turn for pick up by a grid structure at said infeed station.

14. The packer of claim 13 wherein said indexing means comprises individual chain conveyors for each lane and pushers on said chain conveyors to move said article groups at a speed related to the tangential speed of the grid structure by a ratio equal to the trigonometric tangent of the angle A.

15. The packer of claim 14 wherein said individual chain conveyors and the path of their associated article engaging pushers terminate at the infeed station openings, said fingers being supported by individual yoke shaped brackets from the same structue supporting the sprockets of said chain conveyors to provide clearance for said grid structure to move upwardly through said finger openings at said infeed station.

16. The packer of claim 8 wherein each grid structure includes front and rear cross members for supporting the front and rear ends respectively of said support rails, said rear cross member having upwardly projecting portions for so supporting the rear ends of said support rails, and said rear cross member having a lower portion extending laterally below said article support means in said grid structure, and said closed orbital path for said grid structure movement through said infeed station defining an arcuate path for each grid structure such that said rear cross member's lower laterally extending portion passes below said fixed cantilevered fingers.

17. The packer of claim 16 wherein said article support means in each grid structure comprises pivotally mounted vanes provided below said support rails, said vanes in said second or release positions being located in the same plane as the support rails and in said one or support positions said vanes having their upper marginal edges projecting out of the planes of said support rails at least between said posts to prevent articles from dropping downwardly through said pockets.

18. The packer of claim 17 further characterized by means for moving said vanes from said one to said second positions, a discharge station for each grid structure below said infeed station in said orbital path at a location where the velocity of the grid structure is substantially horizontal.

19. The packer of claim 18 further characterized by case conveyor means for moving cases along a path below said grid structure at said discharge station and at a speed closely matched to the horizontal velocity of the grid structure.

20. The packer of claim 18 further characterized by case conveyor means for moving cases along a path below said circular orbit, and below said discharge station provided at the lowest point in said circular orbit.

21. The packer of claim 20 further characterized by variable speed drive means for said case conveyor, said drive means providing a generally sinusoidal variation in the speed of cases moving through said discharge station to match the speed of said cases to the horizontal component of motion for said grid structures during generally circular orbital motion into and out of said discharge station.

22. The packer of claim 21 wherein each grid structure includes a funnel defining portion characterized by depending corner fingers associated with and defining a lower portion of each pocket finger retaining means at the lower end of each corner post, and means resiliently urging the lower end of each finger toward the center of its associated pocket so that two or more fingers engage each article discharged to guide it and slow it's downward motion into the packing case so moved through the discharge station.

23. In a drop packer of the type wherein groups of articles are received in a grid structure provided at an infeed station and wherein the grid structure moves these article groups from the infeed station to a discharge station where the articles are dropped into upwardly open packing cases the improvement to said grid structure characterized by:

(a) grid support rails defining lanes for the articles therebetween, (b) pivotally mounted articles support vanes below said rails and movable between first positions such that upper edges support articles provided between said grid rails and second positions wherein said vanes are located in the same plane as said rails to permit the articles to drop through the grid, (c) means for moving said vanes from said first to said second positions at the discharge station, (d) upwardly projecting posts on said grid support rails, said posts spaced longitudinally on said rails and defining pockets therebetween for receiving articles at the infeed station, and said vanes being pivotally supported in lower portions of certain of said posts.

24. The improvement defined by claim 23 wherein said grid structure further includes forward and aft cross members for supporting the front and rear ends respectively of said grid support rails, said aft cross member having upwardly projecting portions for so supporting the rear ends of said support rails and said aft cross member having lower portions extending laterally below said vanes so that the grid structure can move vertically upwardly through such an infeed station without interfering with the infeed station defining structure.

25. The improvement defined by claim 23 wherein said grid structure further includes clusters of articles guiding fingers mounted in the lower portions of said pocket defining posts, each finger being resiliently biased toward the center of an associated pocket and adapted to move away from such pocket center as an article drops downwardly at the discharge station.

26. The improvement defined by claim 23 further characterized by detection means between said discharge station and said infeed station to provide a signal to indicate whether one or more articles has failed to drop from it's position on one of said grid vanes, said detection means provided at least in part on fixed structure of the packer and comprising photocell/light beam units associated with each lane of the grid, and means for activating said units at a predetermined point in the grid structure's movement.

* * * * *